United States Patent [19]

Kayser

[11] Patent Number: 4,560,328

[45] Date of Patent: Dec. 24, 1985

[54] ROTARY PISTON MACHINE HAVING A PLURALITY OF CHAMBERS CONTAINING RECIPROCATING FLAP PISTONS

[75] Inventor: Albrecht Kayser, Bergisch Gladbach 2, Fed. Rep. of Germany

[73] Assignee: Deutsche Forschungs- und Versuchsanstalt für Luft- und Raumfahrt e.V. Linder Höhe, Cologne, Fed. Rep. of Germany

[21] Appl. No.: 621,473

[22] Filed: Jun. 18, 1984

[30] Foreign Application Priority Data

Jun. 29, 1983 [DE] Fed. Rep. of Germany ..... 3323397

[51] Int. Cl.[4] ..... F01C 1/00

[52] U.S. Cl. ..... 418/8; 418/12; 418/34; 418/176

[58] Field of Search ..... 418/8, 12, 68, 91, 34, 418/36, 176, 265; 91/339; 123/18 R, 43 R, 245; 417/481, 482

[56] References Cited

U.S. PATENT DOCUMENTS

| | | | |
|---|---|---|---|
| 536,393 | 3/1895 | Rice, Jr. | 123/18 R |
| 638,570 | 12/1899 | Forsyth | 123/18 R |
| 1,209,989 | 12/1916 | Mullin | 123/43 R |
| 1,232,850 | 7/1917 | Saunders | 418/34 |
| 1,236,009 | 8/1917 | Saunders | 123/43 RX |
| 1,271,950 | 7/1918 | Saunders | 418/34 |
| 3,871,337 | 3/1975 | Green et al. | 123/43 RX |
| 3,923,013 | 12/1975 | Myers | 123/18 RX |
| 3,948,226 | 4/1976 | Green et al. | 123/18 R |
| 4,099,448 | 7/1978 | Young | 91/339 |

FOREIGN PATENT DOCUMENTS

| | | | |
|---|---|---|---|
| 2757016 | 6/1979 | Fed. Rep. of Germany | 123/245 |
| 800753 | 5/1936 | France | 123/18.R |
| 1277381 | 10/1961 | France | 418/36 |

*Primary Examiner*—William L. Freeh
*Assistant Examiner*—Paul F. Neils
*Attorney, Agent, or Firm*—Diller, Ramik & Wight

[57] ABSTRACT

The rotary piston machine contains a rotor (22) having a plurality of sector-shaped chambers (30). Each chamber (30) houses a flap piston being swivelingly mounted and reciprocated synchroneously with the rotation of the rotor (22). By each of the double acting flap pistons (32) two working compartments are confined, and always two adjacent flap pistons (32) are driven in counterphase to one another. The adjoining working compartments of adjacent piston chambers (30) are commonly connected to inlet and outlet aperture slots (44) in the periphery of the rotor (22). The inlet and outlet ports (42) and ducts (A,B,C,D,E) are provided in the stator (21) around the periphery of the rotor (22).

45 Claims, 4 Drawing Figures

ROTARY PISTON MACHINE HAVING A PLURALITY OF CHAMBERS CONTAINING RECIPROCATING FLAP PISTONS

The invention relates to a rotary piston machine comprising a rotor having a plurality of chambers containing reciprocating flap pistons which define working compartments. It is possible to design such a rotary piston machine as an expansion type (motor) or as a compressor type machine.

According to U.S. Pat. No. 3,871,337, a rotary combustion engine is known comprising a rotor having a plurality of chambers, each of which contains a flap piston reciprocating around a flap shaft and defining a working compartment the volume of which is periodically enlarged or reduced by the movement of the flap piston. In said known rotary piston machine, a flap piston moving in its chamber divides it into a working compartment and a dead compartment which does not contribute to the performance of the engine. So this machine has a large volume, or the engine performance is low respectively. Moreover, the inlet and outlet ducts and ports within the stator have to be provided axially besides the rotor because no radial connection does exist between the working compartments and the rotor periphery. As a result, apertures must be fitted in the end walls of the working compartments thus complicating the sealing and the exact control of the gas exchange.

It is the object of the invention to provide a rotary piston machine having a favorable ratio of performance to volume or performance to weight in company with a high efficiency.

According to the invention, each two adjacent flap pistons are reciprocated in counterphase to each other, each of them providing two working compartments in its piston chamber which is turned by about 120°, as compared with U.S. Pat. No. 3,871,337, into a radial position. Dead spaces behind the flap pistons are avoided accordingly. These are double acting and each of them performs two different operations simultaneously. If gas is compressed in a working compartment at one side, such gas is expelled out of the adjacent working compartment at the other side of the flap piston. But two adjoining working compartments of two adjacent piston chambers are comprised to one inlet and outlet slot in the rotor periphery. This is possible in consequence of the counteraction of two adjacent flap pistons, which contributes to a balance of the mass forces.

The rotary piston machine of the invention may be designed as an effective and compact hydraulic motor or as a hydraulic pump. It seems advantageous that the edges of the pistons, slots and ports which have to be sealed are relatively short thus reducing the problem of sealing the working compartments. Furthermore, the gear required to reciprocate the flap pistons can fortunately be arranged coaxially inside the rotor to result in a very compact design of the total machine. At the same time, the problem of lubricating the gear and the flap pistons can be solved by simple means.

With reference to the enclosed drawings, one embodiment of the invention will be explained hereafter in more details.

Figure 1:
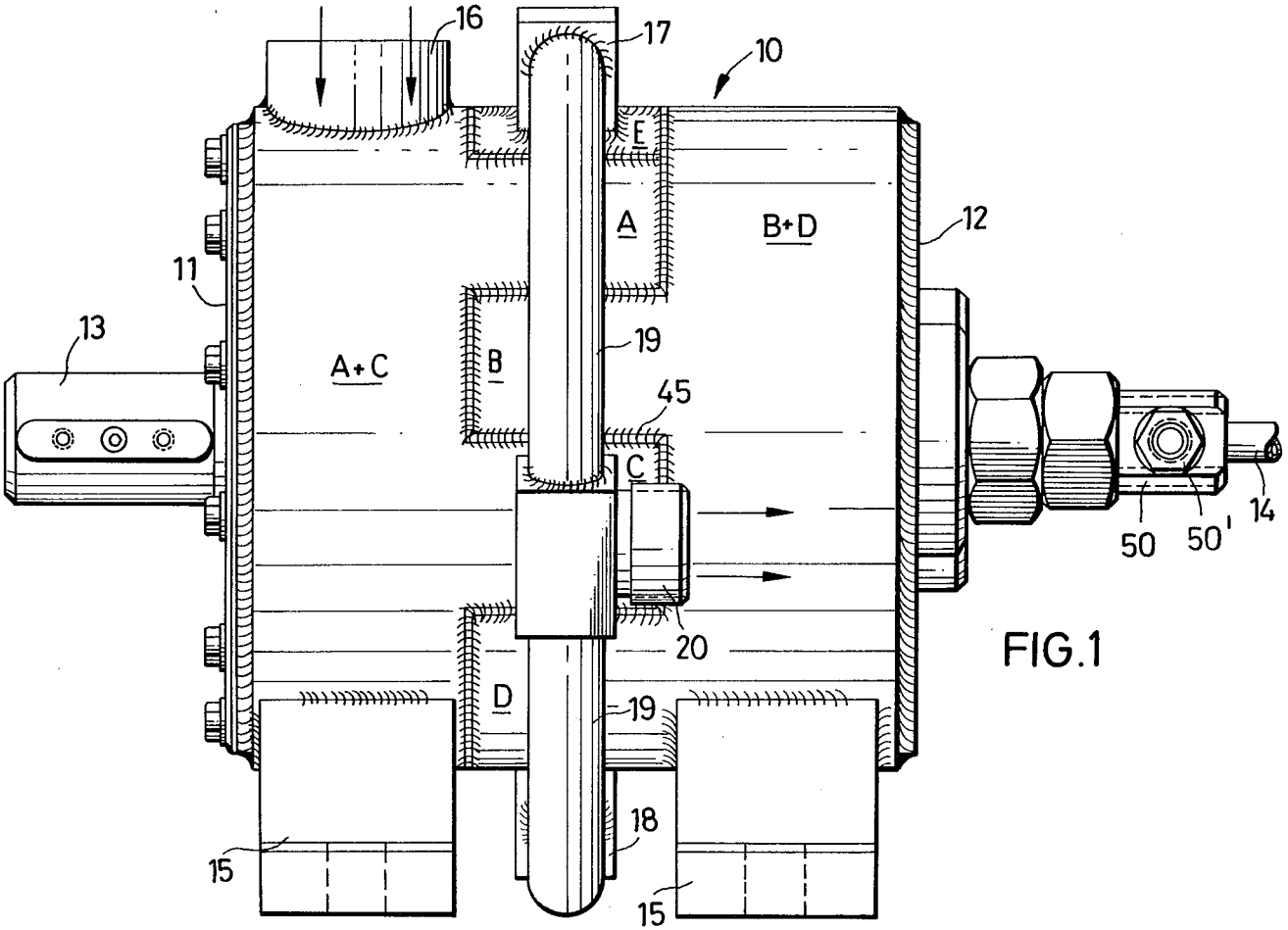
FIG. 1 is a side view of the rotary piston machine.

The illustrated rotary piston machine is of the compressor type, but it could be also operated as an expansion engine by interchanging inlets and outlets. Moreover, one half of the machine can be operated as a compressor and the other half as an expansion engine (motor).

The machine contains a cylindrical housing 10 that is closed by end walls 11,12, the rotary shaft 13 projecting from an opening of the end wall 11 to be connected to a driving means if the machine is operated as a compressor. Two stationary coaxial tubes 50 and 14 for the supply and discharge of lubricating oil extend out of the opposite end wall 12.

The housing 10 rests on feet 15. Its circumferential surface is provided with an inlet 16 to feed in the fluid to be compressed, which is discharged at two outlets 17 and 18 being interconnected by external tubes 19. Said tubes 19 extend to the main outlet port 20.

The housing 10 forms a part of the stator 21 to which also belong tubes 50 and 14. Tube 50 extends into the inside of the rotor 22 and there said tube 50 carries a toothing 23 which forms the sun wheel of a sun-and-planet gear. Rotor 22 is supported via thrust bearings 24,25 and needle bearings 26,27 on the tube 50.

The rotor 22 comprises an annular body 28 which consists of several composed elements and is connected to a flange 29 of the rotor shaft 13 inside the housing 10. Said annular body 28 contains twelve V-shaped chambers 30 uniformly distributed over its circumference and forming each a circular segment room having an angle of nearly 90°. At the inner end of each chamber 30 a flap shaft 31 is supported from which a flap piston 32 protrudes radially. The flap pistons 32 are formed by flat disks which being swivelled around the axes of the flap shafts 31 are reciprocating in the V-shaped chambers 30 from one wall to the other wall. Each chamber 30 is defined peripherally by a wall 33 which is of circular shape and has equal distance from the associated flap shaft 31 in all points. The outer end of the flap piston 32 passes along said wall 33. Accordingly, the annular body 28 forms a crown of chambers 30 each of which is flared symmetrically radially. The reciprocating movement of the flap shafts 31 and of the flap pistons 32 is carried out by connecting rods 34. An eccentric stub shaft 35 supporting a connecting rod 36 is protruding from each end of the flap shaft 31. The other end of the connecting rod 36 is located on a stub shaft 37 which protrudes eccentrically at each end from the shaft 38 of the planet wheel 39. One planet wheel each is provided for each flap shaft 31, the planet wheel 39 being bearing mounted into the rotor between the flap shaft 31 and the sun wheel 40 formed integrally onto the tube 50. The planet wheels 39 are meshing with the teeth 23 of the sun wheel 40. The ratio of the teeth numbers of the sun wheel 40 and the planet wheels 39 is z:1, z representing half the number of flap pistons, e.g. 6 in the instant case. The planet wheels 39 control the movements of the flap pistons 32 in synchronization with the rotation of rotor 22.

Figure 3:
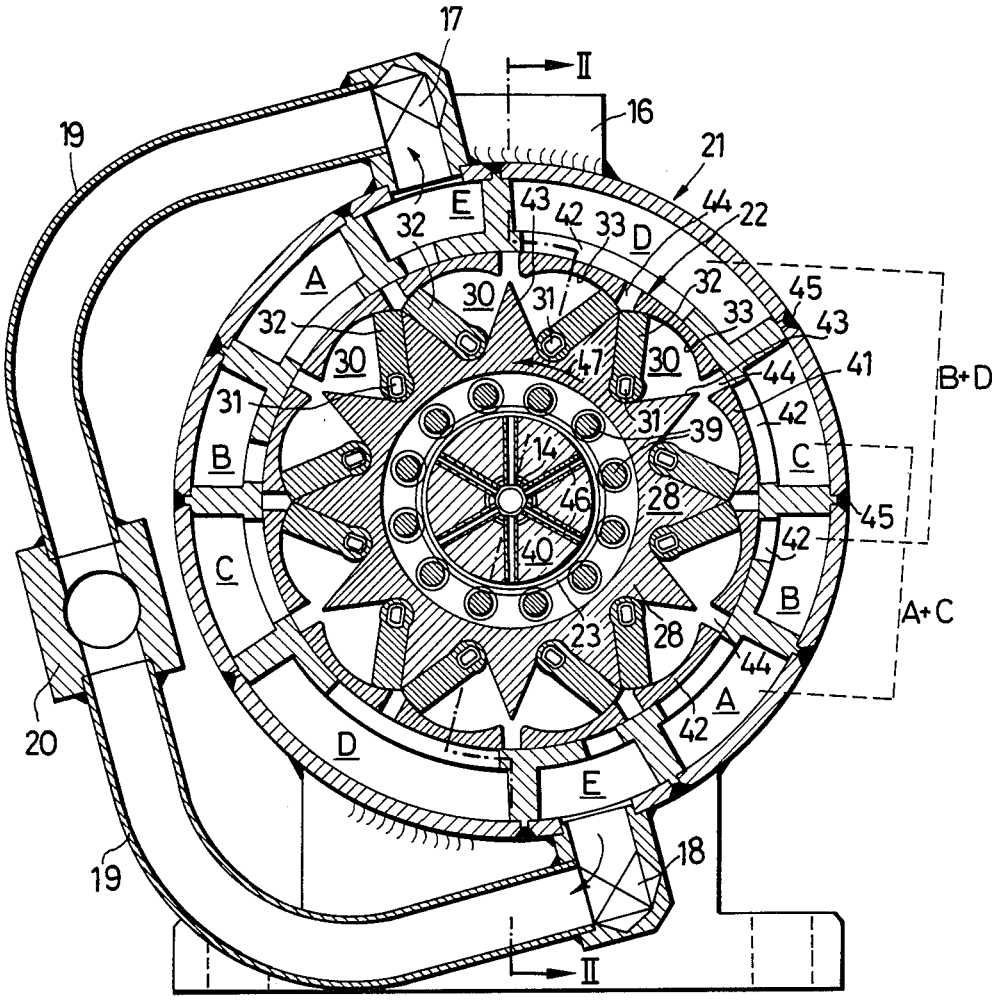
FIG. 3 is a section along line III—III of FIG. 2
Figure 4:
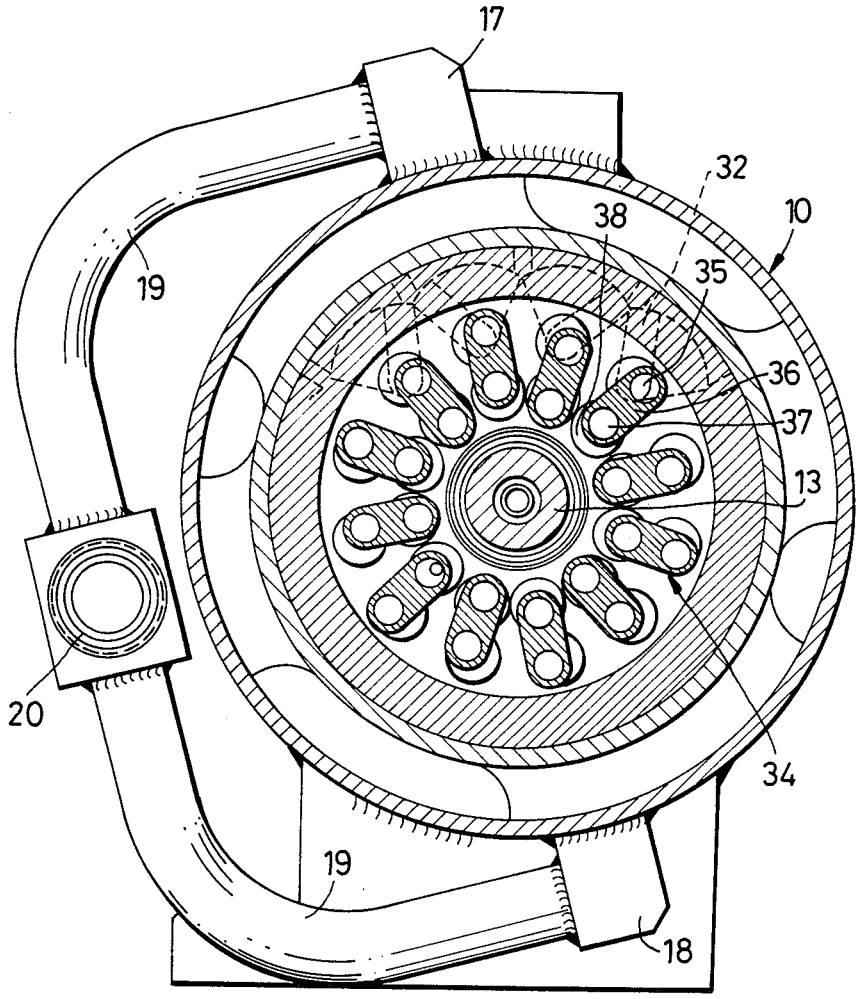
FIG. 4 is a section along line IV—IV of FIG. 2.

As evident from FIG. 3, always two adjacent flap pistons 32 are driven in counterphase to one another, i.e. if one flap piston reaches the left end of its chamber, the adjacent flap piston adjoins the right end of its chamber.

The reciprocating movement of the flap pistons 32 is realised in that the planet wheels 39 continuously revolve along the teeth 23 of the sun wheel 40. By this means, the planet wheel is rotated to cause by the connecting rods 34 the reciprocating swivel movement of the flap piston 32.

Figure 2:
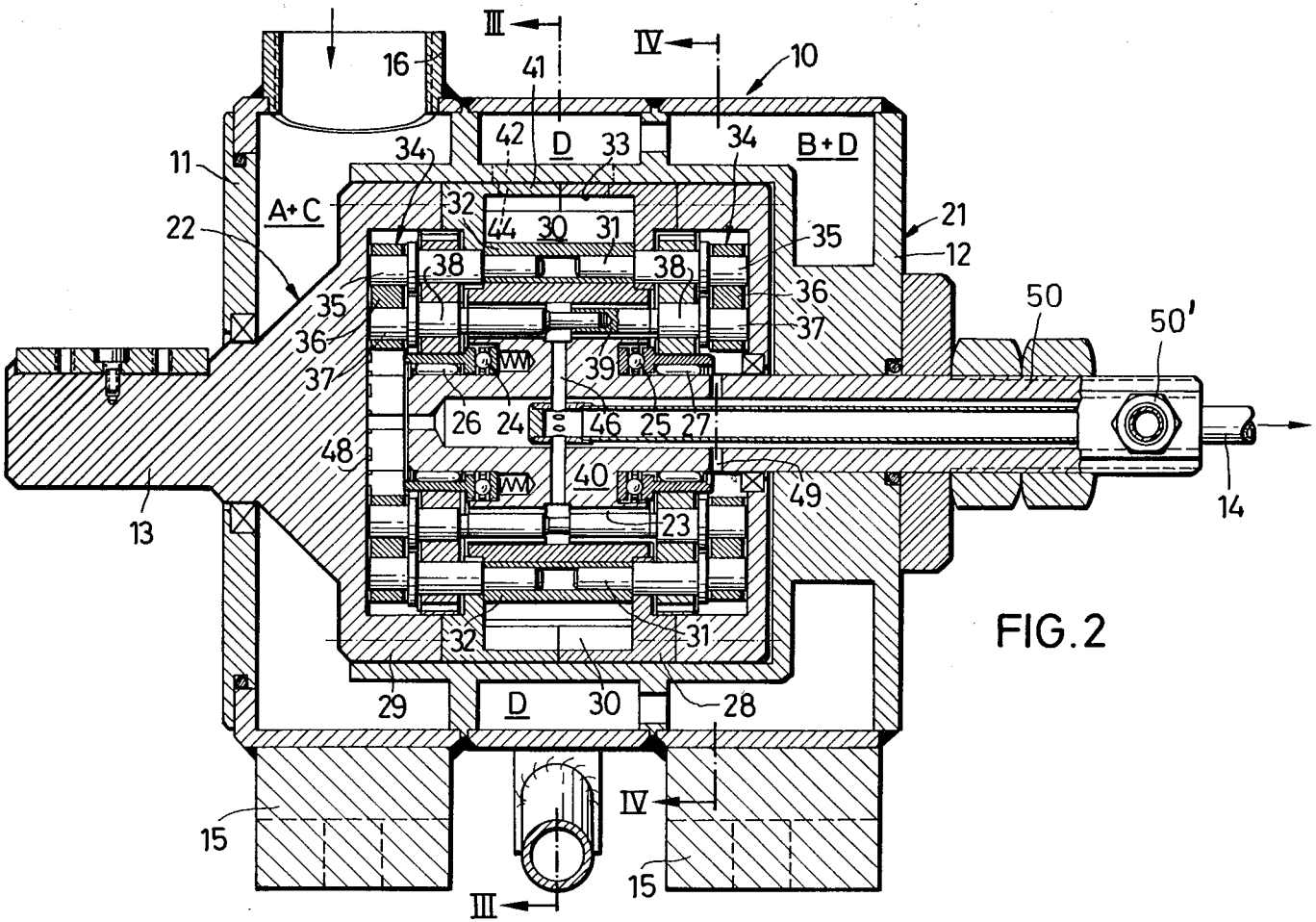
FIG. 2 shows a vertical section of the rotary piston machine along line II—II of FIG. 3.

Walls 33 of the chambers 30 form an annular jacket 41 rotating with the other elements of rotor 22. Said jacket 41 which forms the outer boundary of the rotor 22 is tightly enclosed by the housing 10. The housing has z inlet chambers A,C,D and z outlet chambers B,D,E which inlet and outlet chambers are distributed alternatingly around the periphery of the housing. Window openings 42 are provided at the radially inner walls of the inlet and outlet chambers. Each pair of adjacent inlet and outlet chambers together with the chambers 30 passing upon rotation of the rotor the corresponding windows 42 forms a separate compressor unit. The compressor units may be operated either separately or in groups. Furthermore, it is possible to connect several compressor units in a series. As shown in FIG. 2, in the present embodiment two similar two-stage compressor units are combined with their inlets being connected in parallel and with their outlets being connected in parallel.

The inlet chambers A and C of both primary stages are connected with the inlet 16. The chambers D are the outlets of two primary stages and at the time they act as the inlets of the second stages of each compressor part and they are connected to the two other outlets B of the primary stages. The outlet chambers E of the two second stages are connected by external tubes 19 with the main outlet 20. The connections are shown partly in FIG. 2 and the shapes of the chambers partly can be seen from FIG. 1. FIG. 1 shows the welding seams 45 forming the meanderlike partition line between the chambers. Chambers A,B,C and E extend each over an area of 30° of the circumference, the angular extension being identical to that of the chambers 30. The angular extension of the chambers D is double of that of the remaining chambers, i.e. 60°.

Adjacent chambers 30 are separated by walls 43 radially tapered to the outside. However, adjacent chambers are in communication at the ends of the walls 43. In the zones of joining the jacket 41 is provided with a respective radial slot aperture 44 which passes along the window apertures 42 thus sequentially connecting the working chambers 30 to all inlet or outlet chambers A,B,C,D,E.

As obvious from FIG. 2, the lubricating oil is presssurized through the inlet piece 50' to be introduced into the machine through the inside of the hollow pipe 50. The oil spreads over the grooves 48 and bores 49 into the rotor 22 to be distributed onto the connecting rods 34, the planet wheels 39 and the chambers 30. It gets back to the tubes 46 which extend radially through the sun wheel 40 to end in tube 14 through which the lubricating oil is discharged.

The operation of the machine will be explained hereafter with reference to FIG. 3.

The rotor shaft 13 is turned to rotate the rotor 22 in the direction of the arrow 47. From the chambers A and C which communicate with the inlet 16, gas is absorbed through the apertures 44 and 42 into chambers 30 to be compressed subsequently in a first stage. With the continued rotation of the rotor, the compressed gas is driven into chambers B and D to be subsequently absorbed from chamber D and compressed in a second stage. The gas compressed this way in two stages is urged out into chamber E to get to the outlet 17. Each group of chambers 30 thus performs a double two-stage compression. Chamber D is double as large as the other chambers because it combines the gases of the two first compression stages.

Each flap piston 32 defines two working compartments of which one is enlarged and the other reduced. By this means, a double utilization of each flap piston is realised.

What is claimed is:

1. A rotary piston machine operative as an expansion or compression machine comprising a stator and a rotor, said rotor being disposed in coaxial relationship to said stator, said rotor including a plurality of chambers, means for oscillatingly mounting a flap piston in each of said chambers, each of said flap pistons being connected to a flap shaft supported by said rotor, each flap piston projecting radially outwardly from its associated flap shaft means responsive to rotor rotation for oscillating each two adjacent flap pistons oppositely relative to each other through said flap shafts, said stator including inlet/outlet chambers around its circumference, stator openings associated with said inlet/outlet chambers, openings in an outer periphery of said rotor for selectively placing said chambers in fluid communication with said inlet/outlet chambers through said stator openings, said stator openings having a peripheral extent larger than said rotor openings, and each flap piston dividing its associated chamber into two separate working compartments.

2. The rotary piston machine as defined in claim 1 wherein said stator includes a pair of coaxial tubes for conducting lubricants to and from areas between said stator and rotor.

3. The rotary piston machine as defined in claim 1 wherein said stator inlet/outlet chambers are disposed in at least two similar groups, and at least one inlet/outlet of one group is connected to the respective inlet/outlet of the other group.

4. The rotary piston machine as defined in claim 3 wherein said stator includes a pair of coaxial tubes for conducting lubricants to and from areas between said stator and rotor.

5. The rotary piston machine as defined in claim 1 wherein said stator outlet chambers are connected to a stator inlet chamber to obtain multi-stage compression when said rotary piston machine functions as a compressor.

6. The rotary piston machine as defined in claim 5 wherein said stator inlet/outlet chambers are disposed in at least two similar groups, and at least one inlet/outlet of one group is connected to the respective inlet/outlet of the other group.

7. The rotary piston machine as defined in claim 5 wherein said stator includes a pair of coaxial tubes for conducting lubricants to and from areas between said stator and rotor.

8. The rotary piston machine as defined in claim 1 including a sun gear, a plurality of planet gears in mesh with said sun gear, means eccentrically drivingly connecting each planet gear with an associated flap piston, each said eccentric drive connecting means includes an eccentric shaft connected to each flap piston and planet gear, and a connecting rod connected between each associated flap piston and planet gear eccentric shafts.

9. The rotary piston machine as defined in claim 8 wherein said stator outlet chambers are connected to a stator inlet chamber to obtain multi-stage compression when said rotary piston machine functions as a compressor.

10. The rotary piston machine as defined in claim 8 wherein said stator inlet/outlet chambers are disposed in at least two similar groups, and at least one inlet/outlet of one group is connected to the respective inlet/outlet of the other group.

11. The rotary piston machine as defined in claim 8 wherein said stator includes a pair of coaxial tubes for conducting lubricants to and from areas between said stator and rotor.

12. The rotary piston machine as defined in claim 1 including a sun gear, a plurality of planet gears in meshed with said sun gear, and means eccentrically drivingly connecting each planet gear with an associated flap piston.

13. The rotary piston machine as defined in claim 12 including a sun gear, a plurality of planet gears in mesh with said sun gear, means eccentrically drivingly connecting each planet gear with an associated flap piston, each said eccentric drive connecting means includes an eccentric shaft connected to each flap piston and planet gear, and a connecting rod connected between each associated flap piston and planet gear eccentric shafts.

14. The rotary piston machine as defined in claim 12 wherein said stator outlet chambers are connected to a stator inlet chamber to obtain multi-stage compression when said rotary piston machine functions as a compressor.

15. The rotary piston machine as defined in claim 12 wherein said stator inlet/outlet chambers are disposed in at least two similar groups, and at least one inlet/outlet of one group is connected to the respective inlet/outlet of the other group.

16. The rotary piston machine as defined in claim 12 wherein said stator includes a pair of coaxial tubes for conducting lubricants to and from areas between said stator and rotor.

17. The rotary piston machine as defined in claim 1 wherein each flap piston swings symmetrically relative to a plane passing through the axis of said rotor.

18. The rotary piston machine as defined in claim 17 including a sun gear, a plurality of planet gears in meshed with said sun gear, and means eccentrically drivingly connecting each planet gear with an associated flap piston.

19. The rotary piston machine as defined in claim 17 including a sun gear, a plurality of planet gears in mesh with said sun gear, means eccentrically drivingly connecting each planet gear with an associated flap piston, each said eccentric drive connecting means includes an eccentric shaft connected to each flap piston and planet gear, and a connecting rod connected between each associated flap piston and planet gear eccentric shafts.

20. The rotary piston machine as defined in claim 17 wherein said stator outlet chambers are connected to a stator inlet chamber to obtain multi-stage compression when said rotary piston machine functions as a compressor.

21. The rotary piston machine as defined in claim 17 wherein said stator inlet/outlet chambers are disposed in at least two similar groups, and at least one inlet/outlet of one group is connected to the respective inlet/outlet of the other group.

22. The rotary piston machine as defined in claim 17 wherein said stator includes a pair of coaxial tubes for conducting lubricants to and from areas between said stator and rotor.

23. The rotary piston machine as defined in claim 1 wherein each flap piston performs "z" oscillating movements with one rotation of said rotor and the number of flap pistons is 2z.

24. The rotary piston machine as defined in claim 23 wherein each flap piston swings symmetrically relative to a plane passing through the axis of said rotor.

25. The rotary piston machine as defined in claim 23 including a sun gear, a plurality of planet gears in meshed with said sun gear, and means eccentrically drivingly connecting each planet gear with an associated flap piston.

26. The rotary piston machine as defined in claim 23 including a sun gear, a plurality of planet gears in mesh with said sun gear, means eccentrically drivingly connecting each planet gear with an associated flap piston, each said eccentric drive connecting means includes an eccentric shaft connected to each flap piston and planet gear, and a connecting rod connected between each associated flap piston and planet gear eccentric shafts.

27. The rotary piston machine as defined in claim 23 wherein said stator outlet chambers are connected to a stator inlet chamber to obtain multi-stage compression when said rotary piston machine functions as a compressor.

28. The rotary piston machine as defined in claim 23 wherein said stator inlet/outlet chambers are disposed in at least two similar groups, and at least one inlet/outlet of one group is connected to the respective inlet/outlet of the other group.

29. The rotary piston machine as defined in claim 23 wherein said stator includes a pair of coaxial tubes for conducting lubricants to and from areas between said stator and rotor.

30. The rotary piston machine as defined in claim 1 wherein two respective adjacent rotor chambers are interconnected adjacent a periphery of said rotor at a common wall between adjacent rotary chambers.

31. The rotary piston machine as defined in claim 30 wherein each flap piston performs "z" oscillating movements with one rotation of said rotor and the number of flap pistons is 2z.

32. The rotary piston machine as defined in claim 30 wherein each flap piston swings symmetrically relative to a plane passing through the axis of said rotor.

33. The rotary piston machine as defined in claim 30 including a sun gear, a plurality of planet gears in meshed with said sun gear, and means eccentrically drivingly connecting each planet gear with an associated flap piston.

34. The rotary piston machine as defined in claim 30 including a sun gear, a plurality of planet gears in mesh with said sun gear, means eccentrically drivingly connecting each planet gear with an associated flap piston, each said eccentric drive connecting means includes an eccentric shaft connected to each flap piston and planet gear, and a connecting rod connected between each associated flap piston and planet gear eccentric shafts.

35. The rotary piston machine as defined in claim 30 wherein said stator outlet chambers are connected to a stator inlet chamber to obtain multi-stage compression when said rotary piston machine functions as a compressor.

36. The rotary piston machine as defined in claim 30 wherein said stator inlet/outlet chambers are disposed in at least two similar groups, and at least one inlet/outlet of one group is connected to the respective inlet/outlet of the other group.

37. The rotary piston machine as defined in claim 30 wherein said stator includes a pair of coaxial tubes for conducting lubricants to and from areas between said stator and rotor.

38. The rotary piston machine as defined in claim 1 wherein two respective adjacent rotor chambers are interconnected adjacent a periphery of said rotor at a common wall between adjacent rotary chambers, said rotor includes a cylindrical jacket enclosing said rotor chambers, an aperture in said jacket between each two adjacent rotor chambers, and said apertures being alignable and registrable with said rotor openings upon rotation of said rotor relative to said stator.

39. The rotary piston machine as defined in claim 38 wherein each flap piston performs "z" oscillating movements with one rotation of said rotor and the number of flap pistons is 2z.

40. The rotary piston machine as defined in claim 38 wherein each flap piston swings symmetrically relative to a plane passing through the axis of said rotor.

41. The rotary piston machine as defined in claim 38 including a sun gear, a plurality of planet gears in meshed with said sun gear, and means eccentrically drivingly connecting each planet gear with an associated flap piston.

42. The rotary piston machine as defined in claim 38 including a sun gear, a plurality of planet gears in mesh with said sun gear, means eccentrically drivingly connecting each planet gear with an associated flap piston, each said eccentric drive connecting means includes an eccentric shaft connected to each flap piston and planet gear, and a connecting rod connected between each associated flap piston and planet gear eccentric shafts.

43. The rotary piston machine as defined in claim 38 wherein said stator outlet chambers are connected to a stator inlet chamber to obtain multi-stage compression when said rotary piston machine functions as a compressor.

44. The rotary piston machine as defined in claim 38 wherein said stator inlet/outlet chambers are dispoed in at least two similar groups, and at least one inlet/outlet of one group is connected to the respective inlet/outlet of the other group.

45. The rotary piston machine as defined in claim 38 wherein said stator includes a pair of coaxial tubes for conducting lubricants to and from areas between said stator and rotor.

* * * * *